US006746325B2

(12) United States Patent
Crane

(10) Patent No.: US 6,746,325 B2
(45) Date of Patent: Jun. 8, 2004

(54) HEAT DISTORTING SUPPORT CLIP FOR AIR HANDLING LUMINAIRE

(75) Inventor: Roy B. Crane, Wilmington, MA (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 10/068,205

(22) Filed: Feb. 6, 2002

(65) Prior Publication Data

US 2003/0148730 A1 Aug. 7, 2003

(51) Int. Cl.[7] ..... F24F 11/00; F24F 3/056

(52) U.S. Cl. ..... 454/342; 169/57; 362/218; 362/345

(58) Field of Search ..... 454/342, 349, 454/354, 294; 362/96, 149, 218, 345, 355, 364, 457; 169/45, 56, 57, 60; 49/2

(56) References Cited

U.S. PATENT DOCUMENTS

| | | | | |
|---|---|---|---|---|
| 2,718,290 A | * | 9/1955 | Segil | 52/232 |
| 2,772,742 A | * | 12/1956 | Sprankle | 169/57 |
| 2,800,965 A | * | 7/1957 | Church | 169/57 |
| 2,817,752 A | * | 12/1957 | Florence | 362/355 |
| 3,052,372 A | | 9/1962 | Shepherd et al. | |
| 3,246,137 A | * | 4/1966 | Zagel | 362/218 |
| 3,633,600 A | | 1/1972 | Sadamori | |
| 3,687,055 A | | 8/1972 | Dean et al. | |
| 3,701,895 A | * | 10/1972 | Sweetser | 262/264 |
| RE28,166 E | * | 9/1974 | Meckler | |
| 4,080,978 A | | 3/1978 | McCabe | |
| RE30,204 E | | 2/1980 | Root | |
| 4,263,930 A | | 4/1981 | McCabe | |
| 4,449,589 A | | 5/1984 | McCoy | |
| 4,463,896 A | | 8/1984 | Schaus | |
| 4,494,450 A | | 1/1985 | Avril | |
| 4,627,498 A | | 12/1986 | Aalto et al. | |
| 4,958,687 A | | 9/1990 | Nakagawa | |
| 5,171,184 A | | 12/1992 | Saucier et al. | |
| 5,425,673 A | | 6/1995 | Mahlanen et al. | |
| 6,155,921 A | | 12/2000 | Evans et al. | |
| 6,203,421 B1 | | 3/2001 | Black | |

FOREIGN PATENT DOCUMENTS

| | | | |
|---|---|---|---|
| DE | 24 10 621 | * | 9/1975 |
| JP | 8-102213 | * | 4/1996 |

* cited by examiner

*Primary Examiner*—Harold Joyce
(74) *Attorney, Agent, or Firm*—John F. Salazar; Middleton Reutlinger

(57) ABSTRACT

An air handling luminaire having a light diffuser, louver, or lamp shield made of a flammable material and mounted within a luminaire housing. Integral with the luminaire housing is a heat distortable support clip from which the light diffuser, louver, or lamp shield depends. The luminaire housing also has a ballast channel and at least one reflector mounted therein. The ballast channel and luminaire housing have a plurality of vents and air gaps for fluid communication with an air plenum. The heat distortable support clip non-permanently deforms or distorts when introduced to a predetermined temperature in order to release the lamp shield from the housing and prevent burning thereof.

47 Claims, 2 Drawing Sheets

HEAT DISTORTING SUPPORT CLIP FOR AIR HANDLING LUMINAIRE

BACKGROUND OF THE INVENTION

1. Technical Field of the Invention

The present invention relates to a support for a lamp shield having a flammable component for an air handling luminaire. More particularly, the present invention relates to a heat distortable (without melting) support, which extends away from a lamp shield and removes support, during high temperature conditions so that a lamp shield or louver having a flammable component does not burn in an air handling plenum allowing the fire to spread, in compliance with Standard for Safety UL1598, Paragraphs 9.2.3.2, and 9.2.3.3.

2. Description of the Related Art

Heat transfer luminaires, also known as air handling luminaires, add or remove heat from an area by moving air therethrough. Metal louvers or lamp shields are currently used because they are durable and generally do not catch fire. It is preferable to have a plastic inlay or film within the lamp shields to more accurately direct light and provide desired lighting characteristics. However, since the plastic inlay is flammable it may catch fire and, due to the metal lamp shield beneath, the inlay cannot fall. If the plastic inlay or film catches fire, its close proximity to the air handling system makes likely the spread of fire or fumes through the air handling system which does not does not comply with commercial fire codes.

In view of the deficiencies of known air handling luminaires it is apparent that an air handling luminaire is needed having a metal lamp shield and a plastic inlay which may be released from the air handling luminaire during fire conditions, thus inhibiting the spread of fire through air handling systems.

SUMMARY OF THE INVENTION

It is an objective of this invention to provide a laminated support clip for use with a luminaire.

It is yet an even further objective of the present invention to provide a laminated support clip for a flammable portion of a lamp shield on a luminaire wherein the support clip distorts at a predefined temperature and removes support from the flammable portion of the lamp shield.

It is still an even further objective of the present invention to provide a laminated support clip for a flammable portion of a lamp shield on a luminaire wherein the support clip distorts at a predefined temperature and thus removes support from the flammable portion of the lamp shield and wherein the luminaire may be connected to an air handling plenum for removing air from an area, room, or the like.

An air handling luminaire, comprising a luminaire housing having a top wall and four sidewalls depending therefrom, a light diffuser or lamp shield operably mounted adjacent to the luminaire housing, at least one support clip having a first leg connected to the luminaire body and a second leg supporting the lamp shield. The air handling luminaire support clip is comprised of laminated dissimilar metals and is substantially L-shaped. The support clip has a first long leg and a second short leg. The second leg of the at least one support clip is positioned through the luminaire housing to support the lamp shield. The at least one support clip is connected to the luminaire housing through a hole in the first leg of the at least one support clip.

The lamp shield is preferably formed of both flammable and non-flammable materials. More specifically the lamp shield is metallic having a plastic film on an inner side thereof. Additionally, the lamp shield is preferably concave shaped and flexible.

The luminaire housing is comprised of a top wall and at least one sidewall. At least one reflector is connected between a ballast channel and the luminaire housing. The ballast channel and the top wall preferably have vents for fluid communication with an air handling plenum. The vents are preferably in fluid communication with an air gap. The air gap is formed by the luminaire housing, the at least one reflector, and a ballast channel.

All of the above outlined objectives are to be understood as exemplary only and many more objectives of the invention may be gleaned from the disclosure herein. Therefore, no limiting interpretation of the objectives noted are to be understood without further reading of the entire specification, claims, and drawings included herewith.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE PREFERRED EMBODIMENT

Figure 1:
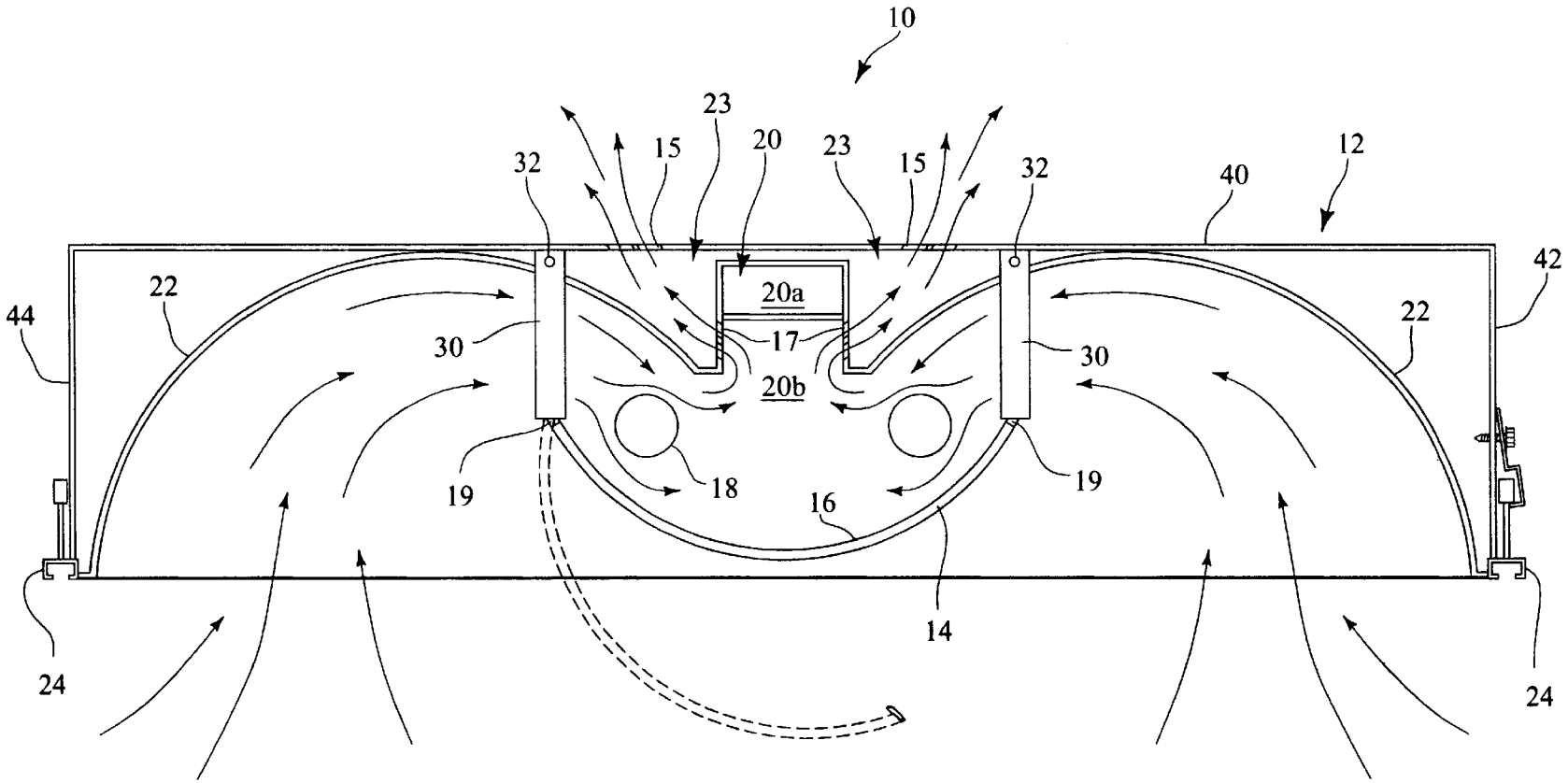
FIG. 1 shows an assembly drawing of the Air Handling Luminaire of the present invention.
Figure 2:
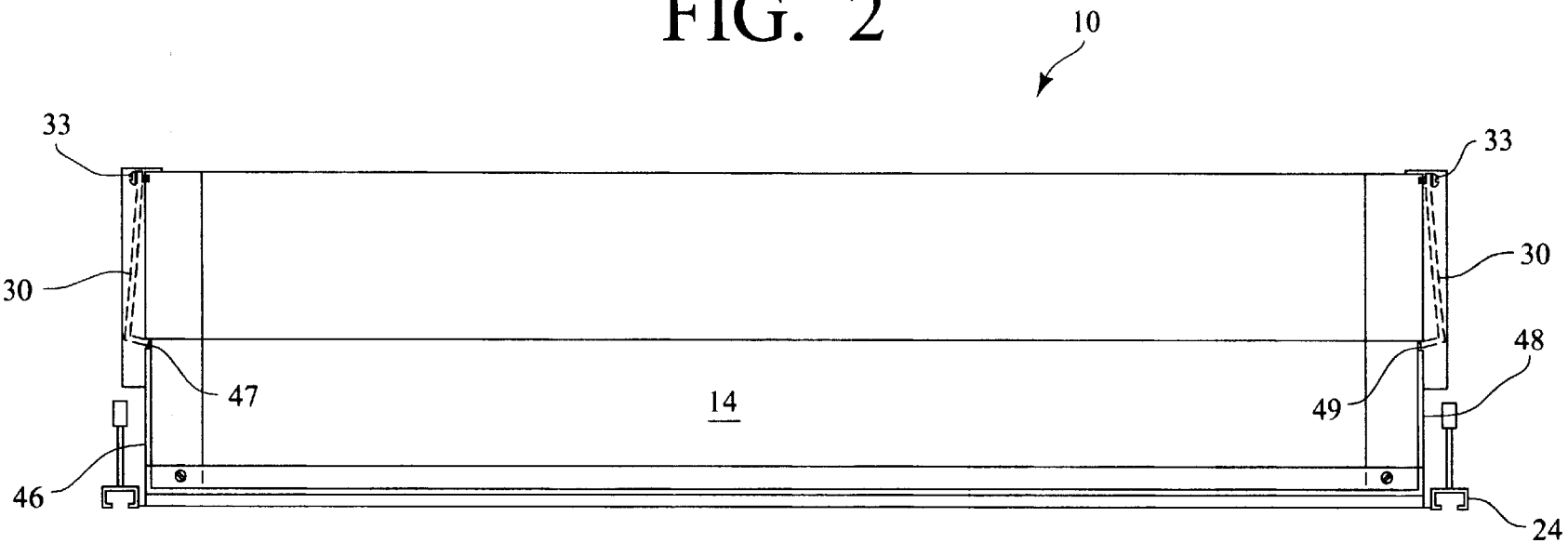
FIG. 2 shows a side view of the Air Handling Luminaire of the present invention of FIG. 1; and, FIG. 3 shows a dissimilar metal support clip of the present invention.

Referring to FIGS. 1 and 2, an air handling luminaire 10 is shown having a luminaire housing or body 12, a lamp shield, light diffuser, or louver 14, and a support clip 30. The support clip 30 provides a means to support the diffuser from the luminaire housing 12 as will be discussed below. The luminaire housing 12 can be of various sizes and shapes required for ceilings in, for example, a commercial building. For instance, in typical commercial buildings, drop or suspended ceilings may be grid like in construction having acoustically absorbent ceiling tiles separated and supported by metal or plastic t-grid 24. The t-grid 24 may alternatively be exposed slot t-grid while the tiles supported by the t-grid 24 may be square or rectangular in shape.

The air handling luminaire 10 may be sized to match the ceiling tile size and provide an improved aesthetic appearance. Each air handling luminaire 10 is located in a ceiling space provided in the grid and is preferably of a size equal to a single ceiling tile, as will be understood by one of skill in the art. The air handling luminaire housing 12 is preferably comprised of an upper top wall 40 and four sidewalls 42,44,46,48 depending from an outer peripheral edge of the top wall 40, but may be of any configuration and such is felt to fall within the teachings herein.

The top wall 40 preferably has vents 15 for allowing air handling between an air plenum and the air handling luminaire 10 of the present invention. For example, some ventilation systems use the space between building floors as an air plenum. A fan is often provided to cause a negative pressure in the space between the floors. The negative pressure in cooperation with the vents 15 pull air from a room or area into the space between floors. The vents 15 also allow heat from the lamp tubes 18 to escape and thus prevent overheating of the luminaire 10.

Within the housing 12 is at least one, preferably two, concave reflectors 22. The reflectors 22 are preferably made of metal and have a reflective coating thereon. The preferably two concave reflectors 22 may extend from the lower ends of sidewalls 42,44 and connect with a ballast channel 20 near the center of the luminaire housing 12. The ballast channel 20 is centrally aligned in the luminaire housing 12 and extends from sidewall 46 to sidewall 48 along top wall 40, in this embodiment. An upper portion 20*a* of the ballast channel 20 contains conductors, wire nuts, and the like typically present in air-handling luminaires. This upper portion 20*a* is closed or sealed to prevent fire from reaching therein as well as protecting the conductors from dirt, dust, and the like.

A lower portion 20*b* of the ballast channel 20 contains a plurality of vents 17 in vertical walls which make up the ballast channel 20. These vents 17 are in fluid communication with vents 15 in the top wall 40 of luminaire housing 12. Thus, vents 17 are also in fluid communication with an air handling plenum (not shown) for moving air into or out of a room, office, or indoor area. An air gap 23 is in fluid communication with vents 17 and 15 and is formed by the ballast channel 20, housing 12, and reflectors 22. The air gap 23 allows airflow from a room or area served by the air handling luminaire 10 to an air plenum above the ceiling level of the room or area.

Connected to the outer surface of the luminaire housing 12 is a heat distortion device or support clip 30. The support clip may be formed of laminated dissimilar metals, dissimilar ceramics, ceramic metal combinations, or the like. Various other materials may be utilized which include combinations of material which deform under high temperature but which do not melt. Thus, the teachings herein are felt to cover various materials which distort before melting in order to release support for the light shield before the temperature is so high as to cause actual melting thereof.

Figure 3:
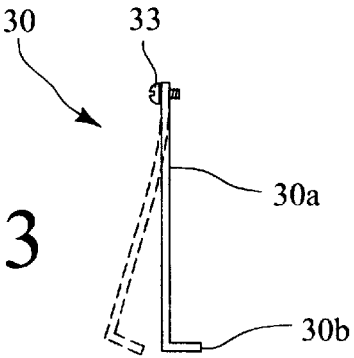

The support clip 30 is preferably substantially L-shaped having a first long leg 30*a* and a second short leg 30*b*. The support clip or heat distortion device 30 may be, for example, made of a bi-metal laminate having an industry designation of P675R. Using dissimilar metals causes the support clip 30 to non-permanently distort or extend away from the luminaire housing 12, as shown in FIG. 3 in broken lines, when introduced to a predefined temperature.

In a preferred embodiment, the first long leg 30*a* has an upper portion with an aperture 32 located therein. Through aperture 32, a screw, a bolt, or a rivet 33 attaches the upper portion of the support clip 30 to the luminaire housing 12.

When the support clip 30 is attached to and integral with the luminaire body 12, the short leg 30*b* must be oriented toward the luminaire housing 12. During installation, the short leg 30*b* of the support clip 30 must extend through the luminaire housing 12.

Also located adjacent to and preferably within the sidewalls of the luminaire body is a lamp shield 14. The lamp shield 14 is preferably concave in shape and made of a microperforated metal. The microperforations provide an awareness of the light source by producing a glow from and around the lamp shield instead of a dark and shadowy area. The lamp shield 14 is also preferably flexible to allow for easy removal and/or opening of the luminaire for changing of the bulbs.

The lamp shield 14 also preferably has a plastic inlay or film 16 on an inner surface of the shield 14. The film 16 also helps to provide a glow along with other desirable lighting characteristics. The film 16 is preferably a soft white colored film producing a soft white lighting effect desirable for office illumination, but may be any desired color. The plastic film 16 conceals a direct image of a lamp tube 18 through the microperforations and provides balance between reflected light and direct light. The lamp 18 may be preferably a fluorescent tube such as, for example, a high lumen compact fluorescent tube. The lamp shield 14 is supported from above in a hanging configuration to depend from the short leg 30*b* of the support clip 30 which is extended interiorly through the luminaire body 12. Preferably, the luminaire housing 12 has a pair of holes 47,49 in sidewalls 46,48 and the lamp shield 14 has at least one hole or flange 19. The pair of holes 47,49 are aligned with holes or flanges 19 on the lamp shield 14 such that when short leg 30*b* of the support clip 30 extends through the sidewalls 46,48 the short leg 30*b* extends through or under the hole or flange 19 to provide support. Preferably, four support clips 30 are used, one at each corner of the lamp shield 14, to support the lamp shield 14. Adjacent the sidewalls 42,44,46,48 are T-grids 24 which support ceiling tiles and connect the ceiling tiles with the air handling luminaires 10 to provide an aesthetically pleasing appearance for a suspended ceiling. The T-grids 24 can be either standard T-grids, exposed slot T-grids, or the like.

In use the air handling luminaire is connected to a return air duct or positioned adjacent a space used as a plenum, such as between floors in a commercial building. The vents 15 and 17 are in fluid communication with an air handling plenum and thus may be used to remove air from a room. The support clips 30 are connected to the upper portions of sidewalls 46,48 using rivets or screws 33. The short leg 30*b* of the support clips 30 should extend through apertures or holes 47,49 in sidewalls 46,48 of the luminaire housing 12 and the lamp shield 14 allowing support of the lamp shield.

To clean the luminaire 10, one may flex the lamp shield 14 so that the flanges 19 are free of the short legs 30*b* along a long side of lamp shield 14. Once free, the lamp shield 14 will hinge along opposed flanges 19 opposite side and hang in an open position, as shown by dotted line in FIG. 1. From this position, the lamps 18 can be changed or the film 16 can be cleaned. To close the lamp shield 14, simply rotate the lamp shield 14 closed and flex the lamp shield 14 until the flanges 19 clear over the short legs 30*b*.

When the air handling luminaire 10 is exposed to high heat conditions, such as during a fire, the support clip 30 extends away from the sidewall 46,48 as shown in FIG. 3. In doing so, support for lamp shield 14 is removed causing it to fall from the air handling luminaire 10. Thus, the plastic inlay or film 16 cannot burn near the air plenum which inhibits spread of fire or smoke through a building.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

I claim:

1. An air handling luminaire, comprising:

an air luminaire housing and a lamp shield comprised of at least one flammable component mounted to said luminaire housing;

at least one support connected to said luminaire housing supporting said lamp shield;

wherein said support is heat distortable without melting, to release said flammable lamp shield from said luminaire housing.

2. The air handling luminaire of claim 1, wherein said at least one support is substantially L-shaped.

3. The air handling luminaire of claim 1, wherein a second leg of said support is positioned through said luminaire housing and supporting said lamp shield.

4. The air handling luminaire of claim 2, wherein said lamp shield has a flammable material on an inner surface thereof.

5. The air handling luminaire of claim 1, wherein said support is connected to said luminaire housing through a hole in said support.

6. The air handling luminaire of claim 1, further comprising a top wall and at least one side wall, at least one reflector connected to a ballast channel and said luminaire housing, said ballast channel and said top wall having vents for fluid communication with an air handling plenum.

7. The air handling luminaire of claim 1, said lamp shield being concave shaped and flexible.

8. The air handling luminaire of claim 1, said lamp shield being metal and having a plastic film on an inner side.

9. An air handling luminaire, comprising:

a top wall and at least one side wall forming a luminaire housing;

at least one dissimilar metal support having a first leg attached to said luminaire housing;

a lamp shield comprised of a flammable material and suspended from said dissimilar metal support.

10. The air handling luminaire of claim 9, wherein at least one dissimilar metal support clip is substantially L-shaped.

11. The air handling luminaire of claim 10, where said dissimilar metal support clip is a dissimilar bi-metal laminate.

12. The air handling luminaire of claim 10, said lamp shield being metal and having a plastic film on an inner surface.

13. The air handling luminaire of claim 10, said lamp shield being substantially concave and flexible.

14. The air handling luminaire of claim 10, further comprising at least one reflector connected to a ballast channel and said luminaire housing.

15. The air handling luminaire of claim 14, said ballast channel and said top wall having vents in fluid communication with an air handling plenum.

16. An air handling luminaire, comprising:

a luminaire housing having vents and an air gap in fluid communication with an air plenum;

a substantially L-shaped support integral with an outer surface of a sidewall of said luminaire housing;

a lamp shield depending from said support clip and having a concave shape and a plastic film on an inner side of said lamp shield;

wherein said support is a dissimilar bi-metal.

17. The air handling luminaire of claim 16, further comprising a ballast channel mounted within said luminaire housing, said ballast channel having vents for fluid communication with said air plenum.

18. The air handling luminaire of claim 16, further comprising at least one reflector connected to a ballast channel and said luminaire housing.

19. The air handling luminaire of claim 16, said lamp shield being flexible.

20. An air handling luminaire, comprising:

a luminaire housing and a flexible light diffuser mounted adjacent to said luminaire housing;

means for supporting said light diffuser from said luminaire housing;

said supporting means being physically distortable upon reaching a predefined temperature; and at least one reflector connected to a ballast channel mounted within said luminaire housing, said ballast channel and said housing having vents for fluid communication with an air handling plenum.

21. The air handling luminaire of claim 20, said vents in fluid communication with an airgap formed by said luminaire housing, said ballast channel, and said at least one reflector.

22. The air handling luminaire of claim 20, said light diffuser being microperforated metal and having a plastic inlay.

23. A method of mounting an air handling luminaire comprising the steps of:

mounting a lamp shield adjacent a luminaire housing;

connecting a first leg of a support clip to said luminaire body, said support clip being a distortable dissimilar metal laminate;

inserting a second leg of at least one support clip through said luminaire housing;

hanging said lamp shield from said second leg of said at least one support clip; and, placing said luminaire housing in fluid communication with an air handling plenum.

24. An air handling luminaire, comprising:

a luminaire housing formed by a top wall and at least one sidewall depending from an outer periphery of said top wall;

said luminaire housing having a dissimilar metal support clip integral therewith;

said dissimilar metal support clip being substantially L-shaped with a first leg and a second leg;

said first leg connected to an outer sidewall of said luminaire housing, said second leg extending through said housing;

a flexible louver having a flammable material on an inner surface of said louver, said louver depending from said second leg of said dissimilar metal clip;

said dissimilar metal laminate being bi-metal;

at least one reflector connected to a ballast channel and depending from said luminaire housing, said ballast channel and said luminaire housing having vents for fluid communication with an air handling plenum; and, an air gap formed by said luminaire housing, said ballast channel, and said at least one reflector.

25. A system for light diffusers, to release and fall free from return air luminaire in the event of a fire, said system comprising:

at least one heat distortion device for supporting a flammable light diffuser from a return air luminaire and designed to distort when heated to a preselected temperature;

at least one light diffuser installed in a return air luminaire and supported by said heat distortion device;

wherein said heat distortion device will release said light diffuser to fall free from said return air luminaire before said light diffuser catches fire.

26. The system for light diffusers of claim 25, further comprising a luminaire body for mounting at least one fluorescent lamp tube, said at least one flammable light diffuser operably mounted to said luminaire body, and said at least one heat distortion device, for attaching and releasing said flammable light diffuser to said luminaire body.

27. The system for flammable light diffusers of claim 26, wherein said heat distortion device is fabricated from laminated dissimilar metallic materials.

28. The system for flammable light diffusers of claim 26, wherein said light diffuser includes both flammable and non-flammable elements.

29. A method for mounting said flammable light diffuser to a return air luminaire comprising:

positioning a return air luminaire in a return air duct;

connecting at least one heat distortion device through at least one hole aligned in a luminaire body;

inserting at least one heat distortion device through aligned holes in a light diffuser and said luminaire body.

30. An air handling luminaire, comprising:

luminaire housing having a top wall and four sidewalls depending therefrom;

a lamp shield operably mounted adjacent to said luminaire housing; and, at least one support clip having a first leg connected to said luminaire body and a second leg supporting said lamp shield;

wherein said at least one support clip is a dissimilar metal laminate.

31. The air handling luminaire of claim 30, said air handling luminaire having an air gap formed by said luminaire housing, a ballast channel, and at least one reflector.

32. The air handling luminaire of claim 31, wherein said at least one support clip is substantially L-shaped.

33. The air handling luminaire of claim 30, wherein said second leg of said at least one support clip is positioned through said luminaire housing and supporting said lamp shield.

34. The air handling luminaire of claim 32, wherein said lamp shield has a flammable material on an inner surface thereof.

35. The air handling luminaire of claim 30, wherein said at least one support clip is connected to said luminaire housing through a hole in said first leg of said at least one support clip.

36. The air handling luminaire of claim 30, further comprising a top wall and at least one side wall, at least one reflector connected to a ballast channel and said luminaire housing, said ballast channel and said top wall having vents for fluid communication with an air handling plenum.

37. The air handling luminaire of claim 30, said lamp shield being concave shaped and flexible.

38. The air handling luminaire of claim 30, said lamp shield being metal and having a plastic film on an inner side.

39. An air handling luminaire, comprising:

a top wall and at least one side wall forming a luminaire housing;

at least one dissimilar metal support clip having a first leg attached to said luminaire housing;

a lamp shield depending from said at least one dissimilar metal support clip and having a flammable material on an inner side;

wherein at least one dissimilar metal support clip is substantially L-shaped.

40. The air handling luminaire of claim 39, said luminaire housing having an air gap therein.

41. The air handling luminaire of claim 39, where said dissimilar metal laminate is bi-metal.

42. The air handling luminaire of claim 39, said lamp shield being substantially concave and flexible.

43. The air handling luminaire of claim 39, further comprising at least one reflector connected to a ballast channel and said luminaire housing.

44. The air handling luminaire of claim 43, said ballast channel and said top wall having vents in fluid communication with an air handling plenum.

45. An air handling luminaire, comprising:

an air luminaire housing and at least one flammable component mounted in said luminaire;

at least one support connected to said flammable component;

wherein said support is heat distortable without melting, to release said flammable component from said luminaire housing.

46. The air handling luminaire of claim 45, said flammable component being a lamp shield.

47. The air handling luminaire of claim 46, said lamp shield being metal and having a plastic film on at least one side.

* * * * *